US008957817B2

(12) United States Patent
Jiang et al.

(10) Patent No.: US 8,957,817 B2
(45) Date of Patent: Feb. 17, 2015

(54) MINIATURIZED AND RECONFIGURABLE CPW SQUARE-RING SLOT ANTENNA INCLUDING FERROELECTRIC BST VARACTORS

(75) Inventors: Hai Jiang, Palatine, IL (US); Guru Subramanyam, Centerville, OH (US)

(73) Assignee: University of Dayton, Dayton, OH (US)

( * ) Notice: Subject to any disclaimer, the term of this patent is extended or adjusted under 35 U.S.C. 154(b) by 238 days.

(21) Appl. No.: 13/489,694

(22) Filed: Jun. 6, 2012

(65) Prior Publication Data

US 2013/0141295 A1 Jun. 6, 2013

Related U.S. Application Data

(60) Provisional application No. 61/493,686, filed on Jun. 6, 2011.

(51) Int. Cl.

| | |
|---|---|
| ***H01Q 13/10*** | (2006.01) |
| ***H01Q 9/04*** | (2006.01) |
| ***H01P 11/00*** | (2006.01) |

(52) U.S. Cl.

CPC ..... *H01Q 13/103* (2013.01); *H01Q 9/0442* (2013.01); *H01Q 9/0464* (2013.01); *H01Q 13/106* (2013.01); *H01P 11/00* (2013.01)

USPC ..... 343/746; 343/769; 29/600

(58) Field of Classification Search

CPC ..... H01Q 13/103; H01Q 13/106

USPC ..... 343/767, 768, 769, 745, 749, 746

See application file for complete search history.

(56) References Cited

U.S. PATENT DOCUMENTS

| | | | | |
|---|---|---|---|---|
| 6,225,959 | B1 * | 5/2001 | Gordon | 343/769 |
| 6,828,942 | B2 * | 12/2004 | Louzir et al. | 343/769 |
| 7,061,333 | B2 * | 6/2006 | Aikawa et al. | 331/56 |
| 7,324,043 | B2 * | 1/2008 | Purden et al. | 342/175 |
| 7,692,270 | B2 | 4/2010 | Subramanyam et al. | |
| 2005/0200530 | A1 | 9/2005 | Aikawa et al. | |

FOREIGN PATENT DOCUMENTS

| | | | |
|---|---|---|---|
| JP | 2006310927 | A | 9/2006 |
| WO | 2005043669 | A1 | 5/2005 |

OTHER PUBLICATIONS

Kuylestierna et al., "Tunable Electromagnetic Bandgap Structures Based on Ferroelectric Films", IEEE, Antennas and Propagation Society International Symposium, vol. 4, pp. 879-882, Jun. 22-27, 2003.

Sarabandi et al., Antenna Miniaturization Techniques for Applications in Compact Wireless Transceivers, www.ursi.org/proceedings/procga02/papers/p2037.pdf, Aug. 2002.

Subramanyam, et al., "A Low Voltage Tunable Analog Phase Shifter Utilizing Ferroelectric Varactors", Integrated Ferroelectrics, vol. 100, No. 1, pp. 156-164, 2008.

Subramanyan et al., "Linearity and Temperature Dependence of Large-Area Processed High-Q Barrium Strontium Titanate Thin-Film Varactors" IEEE Trans. Ultrason. Ferroelectr. Freq. Control, vol. 57, No. 7, pp. 1692-1694, 2010.

Jiang et al., "Frequency Agile Microstrip Patch Antenna Uising Ferroelectric Thin Film Varactor Technology", Proc. IEEE Ap-S Ins. Symp. pp. 1-4, 2009.

Subramanyan et al., "A Si MMIC Compatible Ferroelectric Varactor Shunt Switch for Microwave Applications", IEEE Microwave and Wireless Components Letters, vol. 15, No. 11, Nov. 2005.

PCT/US2012/041028 Search Report and Written Opinion dated Aug. 7, 2012.

* cited by examiner

*Primary Examiner* — Tan Ho

(74) *Attorney, Agent, or Firm* — Dinsmore & Shohl LLP

(57) ABSTRACT

A coplanar waveguide (CPW) square-ring slot antenna for use in wireless communication systems is miniaturized and reconfigurable by the integration of ferroelectric (FE) BST (barium strontium titanate) thin film varactors therein. The slot antenna device includes a sapphire substrate, top and bottom metal layers, and a thin ferroelectric BST film layer, where the FE BST varactors are integrated at the back edge of the antenna on the top metal layer.

11 Claims, 5 Drawing Sheets

MINIATURIZED AND RECONFIGURABLE CPW SQUARE-RING SLOT ANTENNA INCLUDING FERROELECTRIC BST VARACTORS

CROSS REFERENCE TO RELATED APPLICATIONS

This application claims the benefit of U.S. Patent Application Ser. No. 61/493,686, entitled MINIATURIZED AND RECONFIGURABLE CPW SQUARE-RING SLOT ANTENNA INCLUDING FERROELECTRIC BST VARACTORS filed Jun. 6, 2011. The entire contents of said application is hereby incorporated by reference.

TECHNOLOGY FIELD

Embodiments of the invention are directed to a slot antenna for use in wireless communication systems, and more particularly, to a coplanar waveguide (CPW) square-ring slot antenna which is miniaturized and is reconfigurable by the integration of ferroelectric (FE) BST (barium strontium titanate) thin film varactors.

BACKGROUND

With the rapid growth of commercial and military wireless communication systems, the need for compactness has increased. Antennas are considered a critical component of such wireless systems. The desire for compactness has reduced the available space for all of the antennas required on a mobile platform, which in turn has increased the desire for miniaturization of antennas.

Several approaches have been adopted for achieving antenna miniaturization including using different shapes or geometry, complex matching circuits, use of high dielectric constant materials, high temperature superconductors, or capacitive and/or inductive loadings. However, reducing the size of the antenna is typically achieved at the expense of bandwidth, gain, efficiency, and polarization purity, which results in poor antenna performance.

The development of a reconfigurable antenna (RA) is also desirable in wireless communication systems where space is limited, particularly in commercial and military wireless communication systems. For example, with an RA, the frequency, radiation pattern, and polarization of the antenna may be reconfigured, or changed, based on the requirements for different applications. Reconfigurable antennas have been found to be useful for many applications such as broadband or multiband wireless communication, multiple-input multiple-output (MIMO) systems, frequency hopping radar, cognitive radio, and filtering out reserved frequency band for narrow-band wireless technology. In particular, it is desirable for a single reconfigurable antenna to achieve multi-functionality in order to replace multiple ordinary antennas with different functions, and to provide more degrees of freedom for adaptive communication systems.

However, while changing one characteristic of the antenna, another characteristic may also be affected and may be difficult to control. Frequency tunable antennas have been developed with a fixed main beam in the radiation pattern such that both polarization and frequency can be tuned simultaneously and independently for a slot-ring antenna. Many reconfigurable antennas have been achieved electronically by tuning the capacitance of varactor diodes or by switching the "on" and "off" state of PIN-diodes using DC biasing voltages. In addition, RF MEMS technology has been applied to antenna reconfiguration by using RF MEMS varactors and switches.

However, it would be desirable to develop an antenna for use in wireless communication devices which achieves both miniaturization and reconfiguration at the same time.

SUMMARY

Various embodiments of the invention disclosed herein provide an antenna for use in a wireless communication system which is both miniaturized and reconfigurable. The antenna is a CPW (coplanar wave guide) square-ring slot antenna which is miniaturized and reconfigurable by the integration of ferroelectric (FE) BST (barium strontium titanate; $Ba_{(1-x)}Sr_xTiO_3$) varactors at the back edge of the inner conductor, or patch, of the antenna. The frequency of the antenna is reconfigurable due to the tunable capacitance of the FE varactors.

According to one aspect of the invention, A CPW square-ring slot antenna is provided having integral ferroelectric BST (barium strontium titanate) varactors therein; wherein the antenna is miniaturized and reconfigurable. By "varactor", it is meant a variable capacitor. By "miniaturized," it is meant that the geometry of the antenna is reduced in comparison with conventional antennas which are typically half wavelength in dimension. The slot antenna preferably has a size of about $0.1\lambda_0 \times 0.1\lambda_0$ (including ground), where $\lambda_0$ is the free space wavelength for the corresponding lowest frequency of radiation.

By "reconfigurable," it is meant that the frequency bandwidth of the antenna can be tuned (i.e., changed) by applying a dc voltage to tune the varactors. For example, in one embodiment, the frequency of the antenna is reconfigurable from about 5.3 GHz to 5.8 GHz by applying a DC voltage. The frequency range of reconfigurability is about 1.1:1 (i.e., the ratio of the center frequency of the antenna with a voltage to the center frequency of the antenna at zero volts).

In one embodiment, the slot antenna includes a sapphire substrate, a bottom metal layer on the sapphire substrate, a ferroelectric BST thin film layer on the bottom metal layer, and a top metal layer; where the antenna and varactors are included on the top metal layer. Preferably, the sapphire substrate has a dielectric constant of about 9.7.

In one embodiment, the top and bottom metal layers are comprised of gold. In another embodiment, the top and bottom metal layers comprise layers of titanium, platinum, gold, or combinations thereof.

The square-ring slot antenna on the top metal layer preferably comprises an inner patch including a back edge, where the ferroelectric BST varactors are integrated on the back edge. Preferably, from about 3 to 9 varactors are integrated on the back edge.

The bottom metal layer further includes a virtual ground connection and a shunt varactor connection to ground.

The method of making the miniaturized and reconfigurable CPW square-ring slot antenna includes providing a sapphire substrate; applying a bottom metal layer over the sapphire substrate; depositing a ferroelectric BST thin film over the bottom metal layer; and applying a top metal layer over the BST thin film; where the top metal layer comprises an inner patch including a back edge. A plurality of ferroelectric BST varactors are loaded at the back edge of the top metal layer.

Accordingly, it is a feature of embodiments of the invention to provide a CPW square-ring slot antenna which is both miniaturized and reconfigurable by the integration of ferroelectric BST varactors therein which have a tunable capacitance. Other features and advantages of the invention will be apparent from the following detailed description, the accompanying drawings, and the appended claims.

DETAILED DESCRIPTION

Embodiments of the antenna described herein provide many advantages over prior antenna in that the antenna is both miniaturized and reconfigurable. By monolithically integrating nanostructured ferroelectric BST thin film varactors onto the output side (back edge) of the antenna, the size of the antenna is significantly reduced. The miniaturized antenna creates more available space for other modules in the mobile platform and/or reduces the total size. In addition, the antenna is electronically reconfigurable by applying DC biasing voltages on the varactors.

The antenna may be used in wireless communication systems such as universal mobile telecommunication systems (UMTS) and wireless local-area networks (WLAN), aeronautical telemetry, radar remote sensing, microwave radiometry, and rectenna. The antenna may also be designed for use in applications of dual-band, wideband, and circular polarization. The antenna may also be used in applications such as broadband or multiband wireless communication, multiple-input multiple-output (MIMO) systems, frequency hopping radar, cognitive radio, and filtering out reserved frequency band for narrowband wireless technology.

The CPW structure is coplanar (i.e., the signal and ground lines of the transmission line are in the same plane), which makes it flexible for the integration of surface-mounted components such as diodes and varactors without having to drill holes on the substrate. The coplanar structure also avoids the need for any ground plane at the back side of the antenna substrate and simplifies the antenna fabrication process.

As the ferroelectric (FE) BST varactor may be based on a CPW structure, the design and integration is easier for the antenna and varactor when the antenna is also based on a CPW transmission line. However, it should be appreciated that other types of structures can work with the FE varactors. For example, in other embodiments, a frequency agile microstrip patch antenna may be designed by monolithically integrating FE varactors. In addition, other types of varactor loading are possible. For example, varactors may be loaded at each of the 4 corners of the patch in a diagonal fashion.

Figure 1:
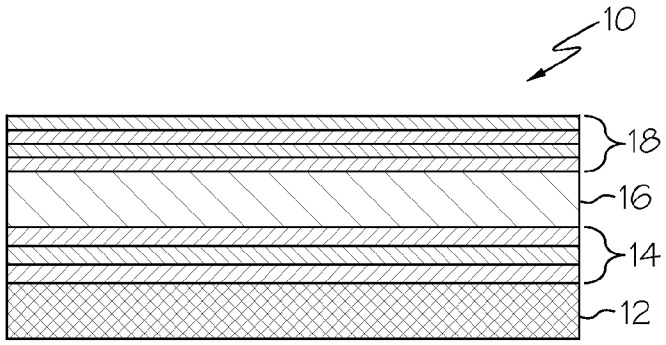
FIG. 1 is a cross-sectional view of the CPW square-ring slot antenna in accordance with an embodiment of the invention.
Figure 2A:
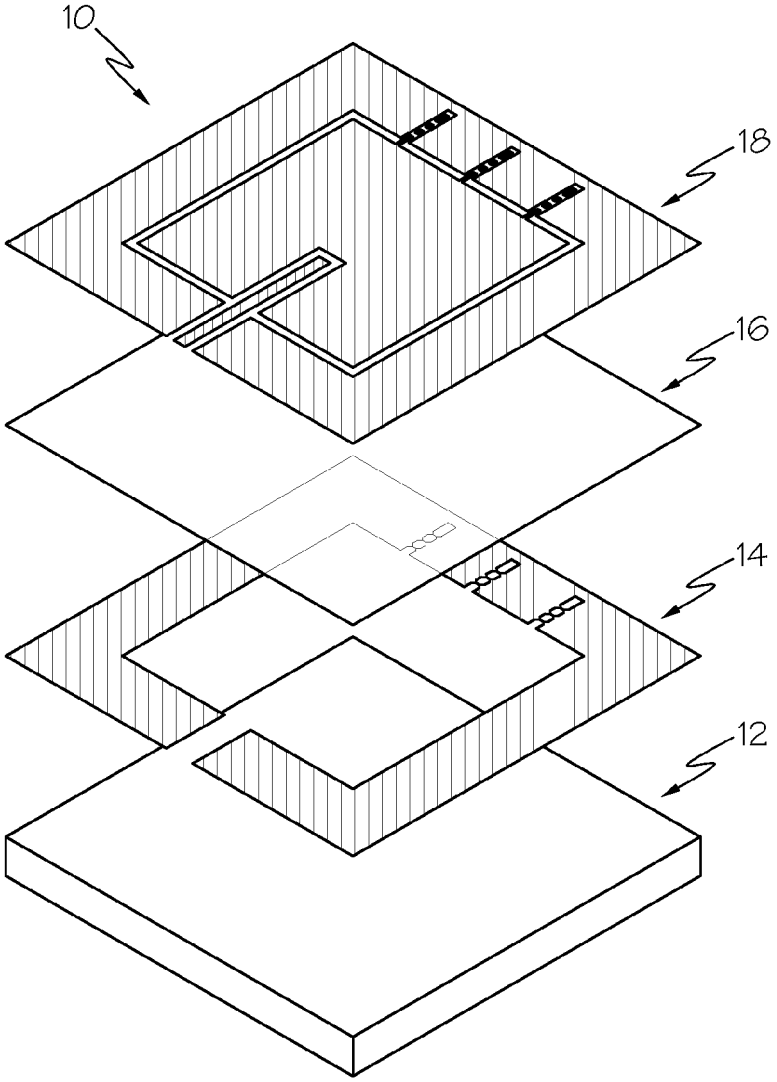
FIG. 2A is an exploded view of an embodiment of the antenna device.

Referring now to FIGS. 1 and 2, a miniaturized and reconfigurable CPW square-ring slot antenna device 10 in accordance with an illustrated embodiment of the invention is shown. As shown in the embodiment of FIGS. 1 and 2A, the antenna device is comprised of four layers, namely a sapphire substrate layer 12 and three device layers 14, 16 and 18. The antenna is fabricated on sapphire substrate 12, which has a thickness (h) of about 500 μm and a dielectric constant of about 9.7. Other suitable substrate layers include silicon, high resistivity silicon, alumina, magnesium oxide, lanthanum aluminate, and any other low loss microwave substrate.

In the embodiment shown, the device layers include a bottom metal layer 14, a BST thin film layer 16, and top metal layer 18. In one embodiment, the top and bottom metal layers are comprised primarily of gold. In other embodiments, the metal layers may include at least one additional layer of titanium (Ti), platinum (Pt), gold (Au) or combinations thereof. While platinum forms the best interface with the BST layer, as platinum is expensive and difficult to grow in thick layers, gold is preferably used as the bulk of the metal layer stack. In the illustrated embodiment, the top metal layer comprises titanium (10-20 nm), followed by platinum (100-200 nm), gold (500-1000 nm), and a thin capping layer of platinum (100-200 nm). The bottom metal layer includes titanium (10-20 nm), platinum (100-200 nm), and gold (200-1000 nm).

The antenna is fed by a CPW transmission line (not shown) on the top metal layer 18 which is between about 40 and 75Ω characteristic impedance, and more preferably, about 50Ω characteristic impedance.

Figure 2B:
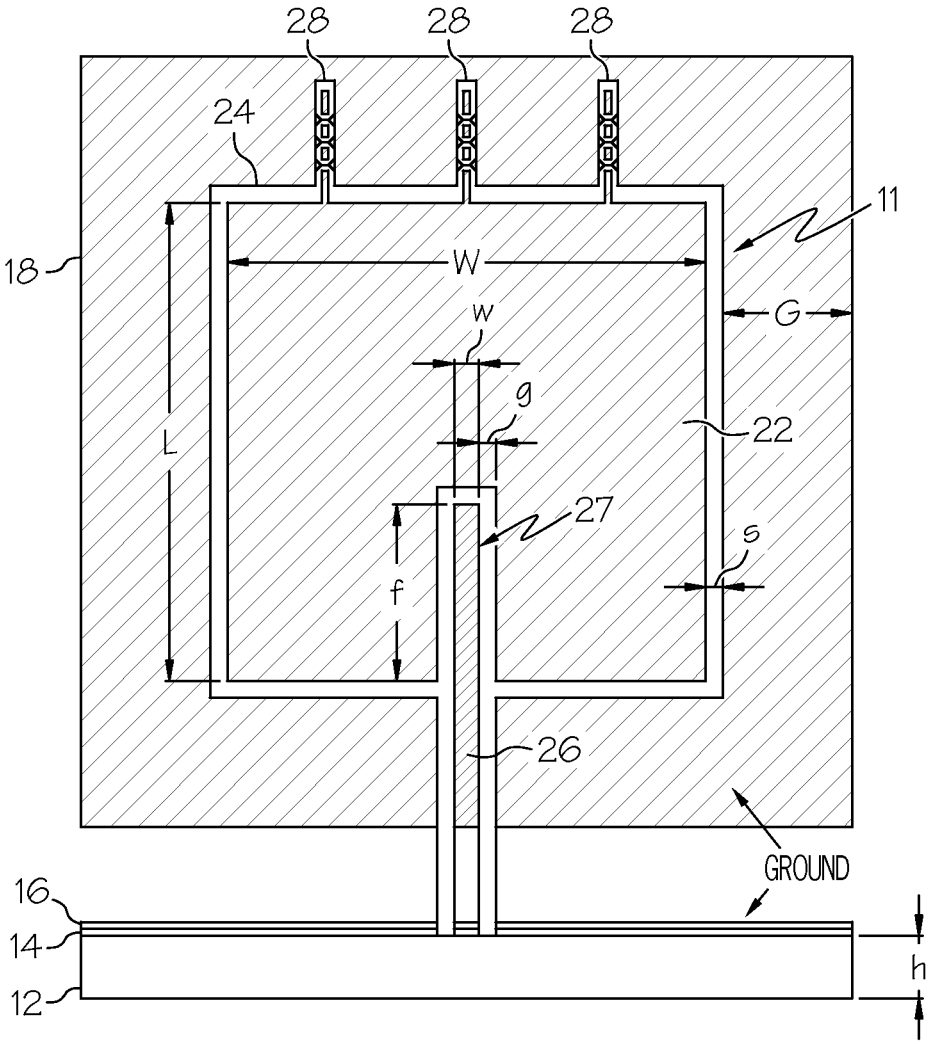
FIG. 2B is a top view of the top metal layer illustrating an embodiment of the antenna.

Referring to FIG. 2B, the size of the square-ring slot antenna 11 is defined by length and width, where L and W are the length and width of the inner patch 22, f is the length of the tuning stub 27 of signal feed line 26, and s is the slot width. In one embodiment, the antenna size is L=3.8 mm, W=3.8 mm, and f=1.5 mm. The gap between the inner patch and the outer ground is about 0.1 mm. The ground width is about 1 mm, so the overall size of the miniaturized antenna is about 6 mm by 6 mm. The CPW signal line has a width w of about 150 μm, and the gap spacing between the signal line and the coplanar ground plane g is between about 125 μm and 250 μm, and more preferably, about 100 μm. It should be appreciated that the CPW lines may also be designed for other pitches, including 125 μm or 250 μm.

The CPW feedline 26 has a tuning stub 27 to obtain better impedance matching. The CPW square-ring slot antenna 11 on top layer 18 is a resonator type antenna. With the tuning stub, the lowest resonance occurs when the perimeter 2(L+W) of the ring slot is equal to the guided wavelength $\lambda_g$. Therefore, the size of the square-ring slot is reduced by about 55% in total area using the tuning stub.

Referring again to FIG. 2B, the antenna 11 includes an inner conductor or patch 22 and a back edge 24. By "back edge," it is meant the side of the inner patch that is opposite the signal feed line 26. Outer signal lines 28 extend from the back edge 24. In the embodiment shown, the inner patch 22 has nine FE BST varactors 30 monolithically integrated therein, e.g., 3 per outer signal line. The varactors are integrated in cascaded form, i.e., in series, as better illustrated in FIG. 3.

The FE BST thin film varactor is essentially a parallel plate capacitor with voltage tuning capability. It should be noted that the top layer ground overlaps with the bottom layer ground (see the overlapping top and bottom metal layers shown in FIG. 3C). The area of the top and bottom layer metal ground pads are about 500 μm×250 μm. This large capacitive coupling between the top and bottom layer grounds avoids the need for any via connection in the antenna device.

It should be appreciated that other configurations may be used for the varactor loading. For example, it is possible to load 1-6 varactors along a single row/outer signal line of the antenna or to load varactors in multiple rows.

The bottom metal layer 14 has at least one virtual ground and a shunt varactor connection to ground as described in commonly-assigned U.S. Pat. No. 7,692,270, the disclosure of which is incorporated herein by reference. The virtual ground forms a large capacitor which is in series with the ferroelectric varactors. The size of the virtual ground is the same as the top surface layer real ground.

Figure 3A:
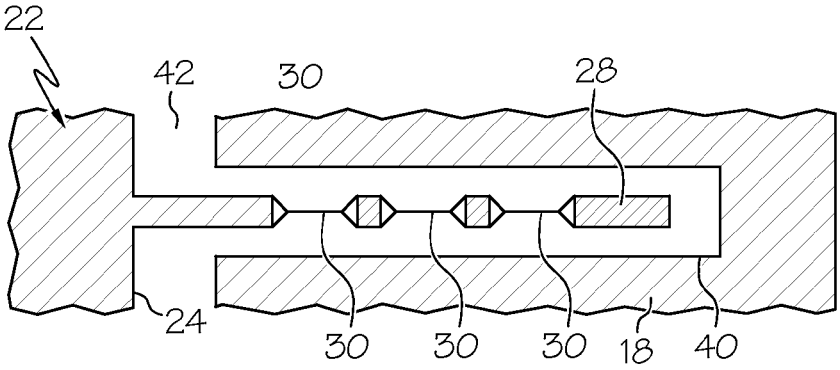
FIGS. 3A, 3B and 3C are enlarged views illustrating how the varactors are integrated into the antenna.
Figure 3B:
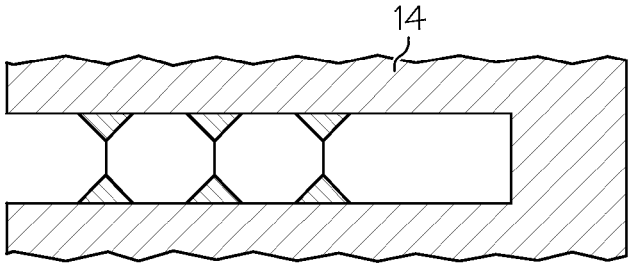
Figure 3C:
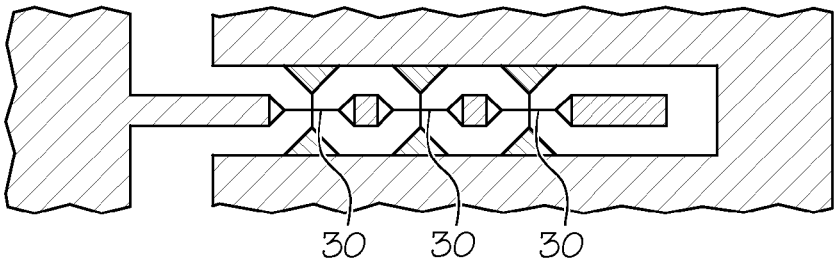

FIGS. 3A, 3B and 3C illustrate an enlarged detail of outer signal line 28 with varactor integration on the antenna illustrated in separate top and bottom layers (FIGS. 3A and 3B and as combined (stacked) top and bottom layers (FIG. 3C). As shown in FIG. 3A, three cascaded BST varactors 30 are integrated with an outer signal line 28 at the back edge 24 of the inner patch 22. A rectangular slot 40 is cut on the ground to accommodate the varactors. Each outer signal line on the top metal layer is designed to match with 50Ω to 150 μm microwave probes. The gap 42 between the ground and each signal line 28 is about 50 μm. The actual capacitor area is about 5 μm×5 μm. The total size of a single FE varactor is about 350 μm×300 μm, including the feedlines at the input and output. The length of the feedlines may vary from about 100 to about 250 μm.

Choosing the total number of varactors is based on the characteristics of the varactors and other design considerations. For example, if too many varactors are cascaded along one line, the shunt resistance may decrease and the device may be shorted as the applied DC voltage increases. If too few varactors are loaded, the simultaneous miniaturization and reconfiguration may not be achieved.

The varactor device consists of feedlines at the input and output and the center section that overlaps with the bottom shunt line. The overlap area of the center signal line with the bottom shunt line creates the varactor. As the varactor area should be about 5 μm×5 μm, the 50 μm signal line 28 is tapered to about 5 μm wide in the center portion of the varactor. Thus, the tapered portions on the top layer signal line 28 are used to match the impedance with and define the inner thin signal line portions. Each inner thin signal portion extends about 50 μm between the respective tapered portions.

The true capacitor is formed by the overlapping areas of the thin signal line portions on the top layer 18 and the shunt inductive line on the bottom metal layer 14. The BST thin film has a dielectric constant of about 1000 at zero bias and tunes to 250 at 8V. The film thickness can be controlled during deposition and preferably is about 250 nm. The capacitance may be adjusted by changing the overlapping area of the two metal lines. For example, a varactor with an overlapping area of about 5×5 $\mu m^2$ has a capacitance value from about 0.97 pF to 0.25 pF as the DC voltage is tuned from 0V to 8V on a sapphire substrate.

In order that the invention may be more readily understood, reference is made to the following examples which are intended to illustrate various embodiments of the invention, but not limit the scope thereof.

Example 1

A miniaturized and reconfigurable CPW square-ring slot antenna was constructed on a 500 μm thick and 100 mm diameter sapphire wafer. The top and bottom metal layers were comprised of gold. The bottom metal was coated with a 0.25 μm thick $Ba_{0.6}Sr_{0.4}TiO_3$ (BST) thin film. A Neocera Pioneer 180 pulsed laser deposition (PLD) system was used to deposit the BST thin film.

The return loss of the antenna was tested by an HP 8720B vector network analyzer with a frequency sweep of up to 20 GHz. A Keithly source meter was used to provide the DC biasing voltage to the varactors. The probe was connected with port no. 1 of the network analyzer through Semflex RF/microwave cables.

It should be appreciated that the antennas were based on coplanar structure without any ground plane below the substrate. However, for the microprobe test station, the platform used to hold the wafer was made of metal. When the antenna is laid over the metal platform directly, it will behave as an equivalent ground on the bottom of the substrate and the measured return loss will be affected by the platform. In this instance, the feed line and antenna worked as a conductor-backed CPW structure. To eliminate the conductor effect of the metal platform on the CPW antenna, part of the wafer where the CPW antenna was fabricated was moved out of the platform (no metal underneath the CPW antenna) during the testing. Part of the wafer was inside the test platform and held by the vacuum on the wafer chuck platform.

The far field radiation patterns for the antennas were tested in an anechoic chamber. A portable probe station was used for the far field testing inside the anechoic chamber. The tested gain and efficiency was affected by the use of microwave probes. During the test, the probe station was covered by a microwave absorber to absorb the electromagnetic energy as much as possible to minimize the reflection. However, some areas were impossible to cover and may have reflected some electromagnetic fields, which may have affected the pattern measurement results.

During the test, the probe station and the wafer containing the antenna were vertically mounted in order to work with the anechoic chamber test set up.

Figure 4:
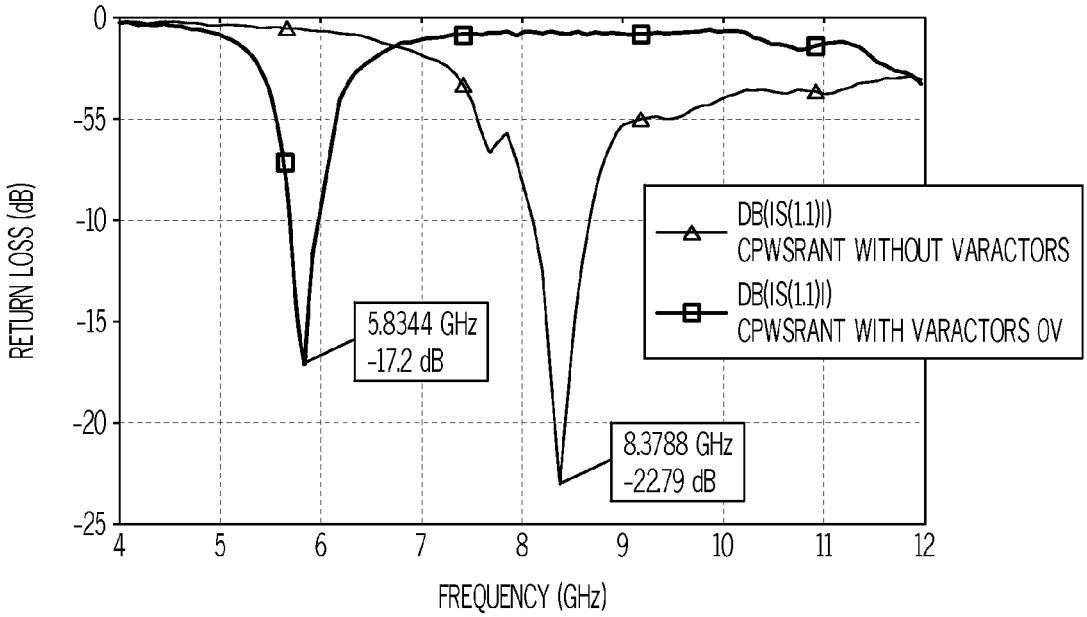
FIG. 4 is a graph illustrating the return loss for antennas with and without varactor loading.

Referring to FIG. 4, the solid line represents return loss for the regular CPW square-ring slot antenna without integrating any FE varactors, and the dashed line represents the same antenna design with three cascaded BST varactors loaded at the back edge of the antenna. The resonant frequency was reduced from 8.4 GHz to 5.8 GHz by loading BST varactors. The size of the miniaturized antenna was 4 mm×4 mm without ground, and equal to $0.067\lambda_0 \times 0.067\lambda_0$. With ground, the size of the miniaturized antenna was equal to $0.12\lambda_0 \times 0.12\lambda_0$, where $\lambda_0$ is the free space wavelength at the resonant frequency.

Figure 5:
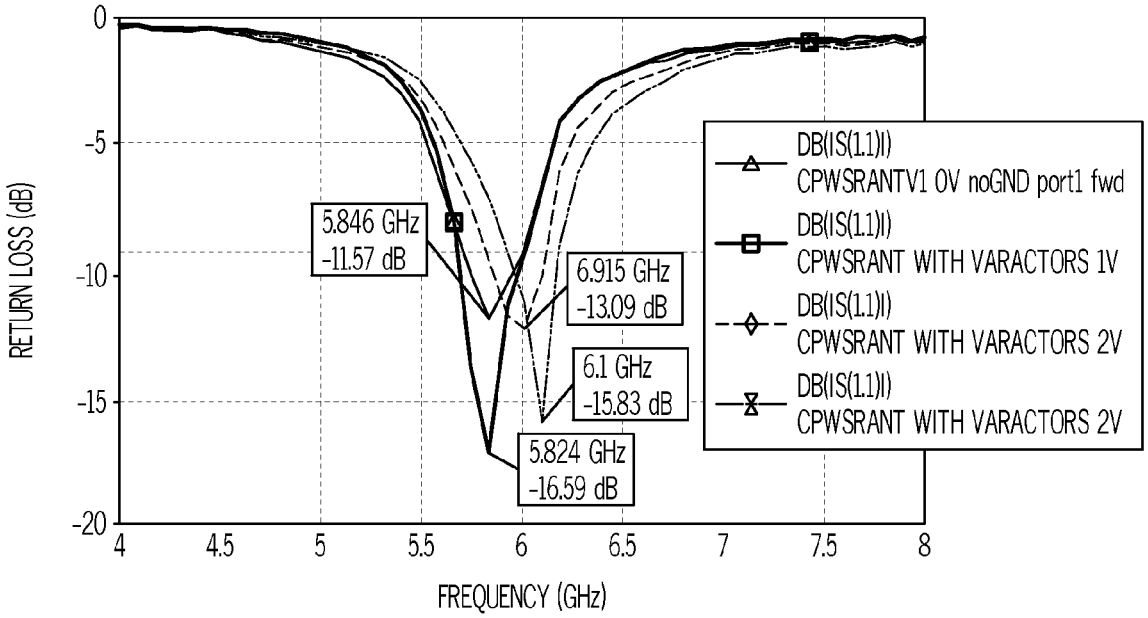
FIG. 5 is a graph illustrating the reconfiguration of an antenna by applying a DC bias to tune the varactors.

FIG. 5 shows the return loss with applying DC voltages from 0V to 3V to tune the varactors. The resonant frequency of miniaturized antenna was reconfigured from 5.82 GHz up to 6.1 GHz. Thus, the antenna is able to operate at 5.82 GHz as well as 6.1 GHz. The DC biasing voltages were linearly increased by 0.5V per measurement.

An E-plane (electric field plane) and H-plane (magnetic field plane) radiation pattern was obtained for the on-wafer probed antenna with no varactor loading. This antenna was fabricated on the BST thin film layer similar to the antenna with varactor loading.

E-plane and H-plane co-polarized patterns of the varactor loaded miniaturized and reconfigurable CPW square-ring slot antenna were also measured. Patterns were normalized with a maximum gain measured at −3 dBi. The measured gain of this antenna was lower than the traditional CPW square-ring slot antenna (i.e., not fabricated on a BST substrate and not loaded with varactors), primarily because the impedance match is influenced by the metal platform during the far field test. It was also observed that the E-plane pattern dropped to −20 dB at 30° and the beamwidth for both H and E planes decreased with varactor loadings. This was due to the virtual ground of the bottom metal layer. The ripples and the separated beam in the patterns were due to the influence of the uncovered part of the probe station and microwave probes.

The varactor loaded antenna exhibited a slightly higher loss than the varactor-free antenna. Thus, the varactor-loaded antennas can operate at multiple frequencies compared to the varactor-free antennas as one can tune the operating frequency of the antenna using the DC voltage applied to the varactors.

Example 2

Figure 6:
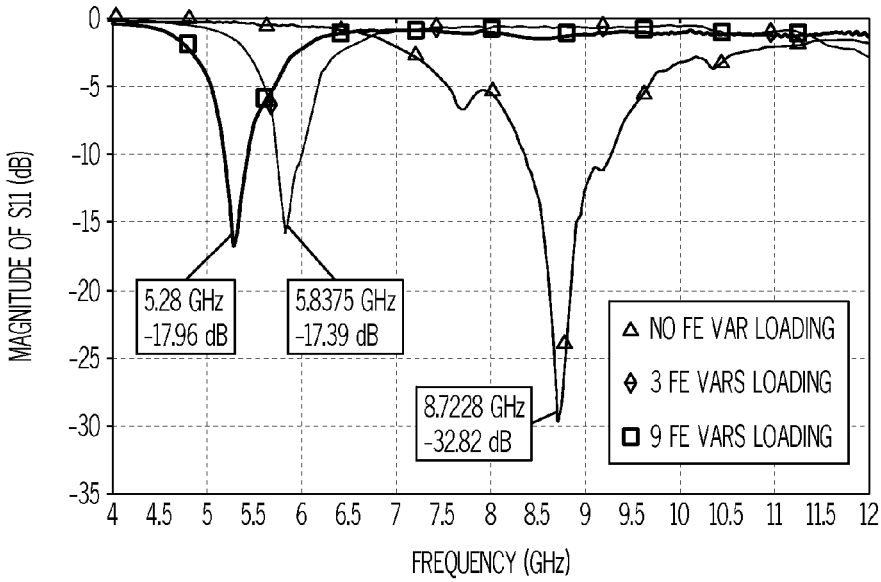
FIG. 6 is a graph illustrating the return loss for antennas with and without varactor loading.

Three ferroelectric antennas were formed in accordance with embodiments of the invention. The first antenna had no varactor loading, the second antenna had 3 varactor loadings, and the third antenna had 9 varactor loadings. FIG. 6 illustrates the magnitude of S11 or return loss for the three antennas. As shown in FIG. 6, the resonant frequency for the third antenna was reduced from 8.7 GHz to 5.3 GHz after loading 9 ferroelectric BST varactors. Thus, the size of the antenna was equivalently reduced by 40% to a dimension of $0.1\lambda_0 \times 0.1\lambda_0$ including the outside ground of the antenna, where $\lambda_0$ is the free space wavelength.

Figure 7:
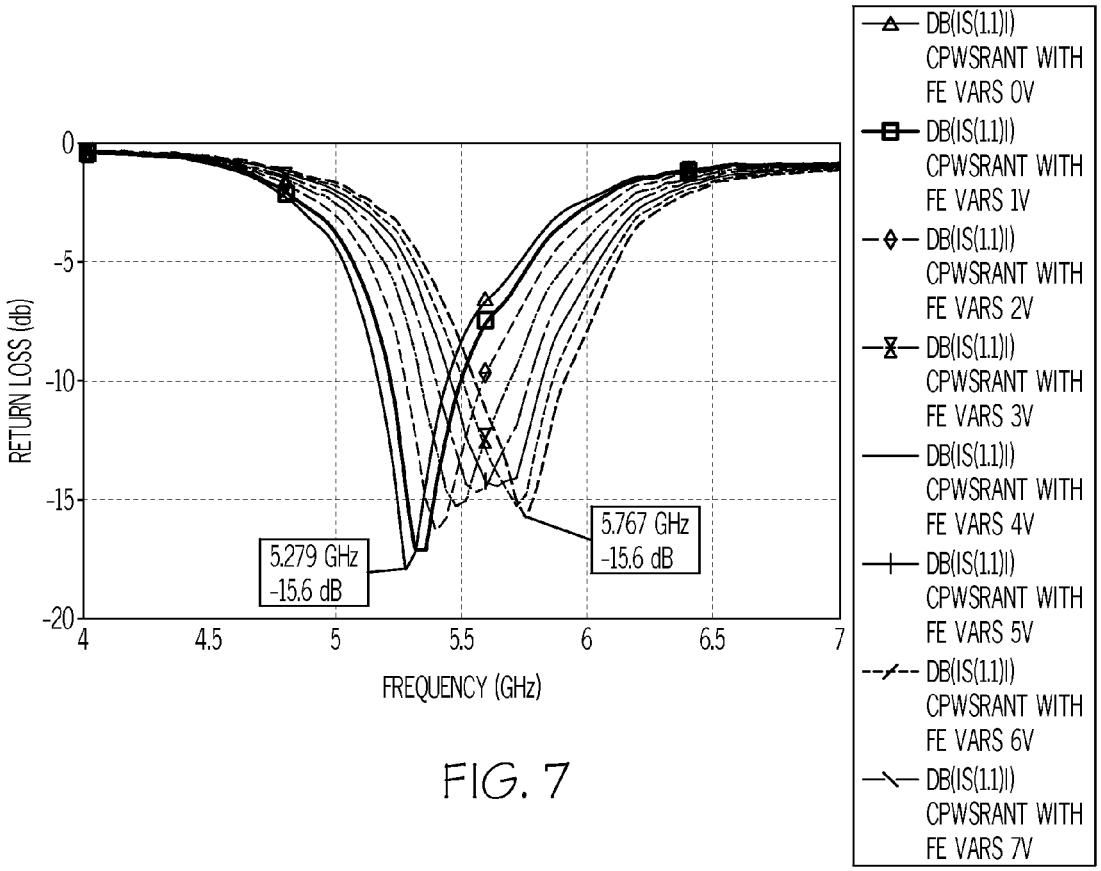
FIG. 7 is a graph illustrating the return loss for an antenna having 9 ferroelectric BST varactor loadings reconfigured by applying DC biasing voltages.

FIG. 7 illustrates the return loss for the third antenna having 9 ferroelectric BST varactor loadings with DC biasing voltages ranging from 0V to 7V. The return loss was tested using an HP network analyzer 8720B. The operational frequency of this antenna was reconfigurable from about 5.2 GHz to about 5.8 GHz.

Having described the invention in detail and by reference to preferred embodiments thereof, it will be apparent that modifications and variations are possible without departing from the scope of the invention.

What is claimed is:

1. A CPW square-ring slot antenna having integral ferroelectric BST (barium strontium titanate) varactors on a back edge thereof; wherein said antenna is miniaturized and reconfigurable.

2. The slot antenna of claim 1 further including a sapphire substrate, a bottom metal layer on said substrate, a BST thin film layer on said bottom metal layer, and a top metal layer; wherein said antenna and said varactors are included on said top metal layer.

3. The slot antenna of claim 2 wherein said sapphire substrate has a dielectric constant of about 9.7.

4. The slot antenna of claim 2 wherein said top and bottom metal layers are comprised of gold.

5. The slot antenna of claim 2 wherein said top and bottom metal layers comprise titanium, platinum, gold, or combinations thereof.

6. The slot antenna of claim 1 having a size of about $0.12\lambda_0 \times 0.12\lambda_0$.

7. The slot antenna of claim 1 wherein the frequency of the antenna is reconfigurable from about 5.3 GHz to 5.8 GHz.

8. The slot antenna of claim 1 comprising an inner patch including said back edge, wherein said ferroelectric BST varactors are integrated on said back edge.

9. The slot antenna of claim 1 wherein from 3 to 9 varactors are integrated on said back edge.

10. A method of making a miniaturized and reconfigurable CPW square-ring slot antenna comprising:

providing a sapphire substrate;

applying a bottom metal layer over said sapphire substrate;

depositing a ferroelectric BST thin film over said bottom metal layer;

applying a top metal layer over said BST thin film; said top metal layer comprising an inner patch including a back edge; and loading a plurality of ferroelectric BST varactors at the back edge of said top metal layer.

11. The method of claim 10 wherein about 3 to 9 ferroelectric BST varactors are loaded at the back edge of said top metal layer.

* * * * *